US009523222B2

(12) United States Patent
Zhang et al.

(10) Patent No.: US 9,523,222 B2
(45) Date of Patent: Dec. 20, 2016

(54) PUSH/PUSH LATCH

(75) Inventors: Miao Zhang, Aurora, IL (US); Toby Berry, Jr., Steger, IL (US); Daniel Calby, Mokena, IL (US)

(73) Assignee: ILLINOIS TOOL WORKS INC, Glenview, IL (US)

( * ) Notice: Subject to any disclaimer, the term of this patent is extended or adjusted under 35 U.S.C. 154(b) by 175 days.

(21) Appl. No.: 14/119,693

(22) PCT Filed: Aug. 8, 2012

(86) PCT No.: PCT/US2012/049886
§ 371 (c)(1),
(2), (4) Date: Nov. 22, 2013

(87) PCT Pub. No.: WO2013/022907
PCT Pub. Date: Feb. 14, 2013

(65) Prior Publication Data

US 2014/0145453 A1 May 29, 2014

Related U.S. Application Data

(60) Provisional application No. 61/521,516, filed on Aug. 9, 2011.

(51) Int. Cl.
*E05C 19/02* (2006.01)
*E05C 1/08* (2006.01)
(Continued)

(52) U.S. Cl.
CPC ..... *E05C 1/08* (2013.01); *E05B 77/06* (2013.01); *E05B 83/28* (2013.01); *E05C 19/022* (2013.01); *Y10S 292/04* (2013.01); *Y10S 292/22* (2013.01)

(58) Field of Classification Search
CPC ..... E05C 1/08; E05C 19/022; E05B 15/16; E05B 15/1607; E05B 17/2007; E05B 77/06; E05B 77/36; E05B 77/38; E05B 83/28; Y10T 292/0878; Y10S 292/04; Y10S 292/22
(Continued)

(56) References Cited

U.S. PATENT DOCUMENTS 4,885,954 A * 12/1989 Wanlass ..... E05B 81/25 250/227.12
5,090,751 A * 2/1992 Kobayashi ..... B60N 3/08 292/210
(Continued)

FOREIGN PATENT DOCUMENTS

EP 0475244 A2 3/1992
JP 2710096 B2 * 2/1998
(Continued)

OTHER PUBLICATIONS

Corresponding International Application No. PCT/US2012/049886 Search Report dated Nov. 28, 2012.

*Primary Examiner* — Christine M Mills
(74) *Attorney, Agent, or Firm* — Paul F. Donovan

(57) ABSTRACT

The instant disclosure provides a push latch having a pivotally mounted blocking hammer including a head with a lever arm extending away from the head to a counter-weight. Under normal operating conditions, the hammer is held in an inert/balanced condition. Under such normal conditions, a portion of the hammer head may be in periodic contact with a resin of tacky character defining a bumper to aid in dampening vibration. Upon the occurrence of a high impact force, the rotational force provided by the counterweight is sufficient to cause the hammer to rotate into blocking relation relative to the latching mechanism so as to prevent unlatching. In the rotated condition, the counterweight may be in contact with an optional resin of tacky character defining a bumper to reduce rebound action.

14 Claims, 6 Drawing Sheets

(51) Int. Cl.
*E05B 77/06* (2014.01)
*E05B 83/28* (2014.01)

(58) Field of Classification Search
USPC ..... 292/74, 164, DIG. 22, 332, DIG. 4
See application file for complete search history.

(56) References Cited

U.S. PATENT DOCUMENTS

| | | | | |
|---|---|---|---|---|
| 5,520,313 | A * | 5/1996 | Toshihide | B60N 2/4686 220/815 |
| 6,386,986 | B1 * | 5/2002 | Sonner | A47D 13/105 297/273 |
| 7,303,216 | B2 | 12/2007 | Bella et al. | |
| 7,393,024 | B2 | 7/2008 | Bella | |
| 7,607,703 | B2 * | 10/2009 | Cho | E05B 77/06 292/137 |
| 7,607,727 | B2 * | 10/2009 | Park | B60N 2/4686 292/131 |
| 7,766,407 | B2 * | 8/2010 | Nakaya | B60N 3/08 292/334 |
| 2007/0046037 | A1 | 3/2007 | Cho | |
| 2008/0023967 | A1 * | 1/2008 | King | E05B 77/06 292/64 |

FOREIGN PATENT DOCUMENTS

| | | | |
|---|---|---|---|
| JP | 2002106238 | A | 4/2002 |
| WO | 2008013674 | A2 | 1/2008 |

* cited by examiner

PUSH/PUSH LATCH

RELATED APPLICATIONS

The present application is a National Phase of International Application Number PCT/US2012/049886, filed Aug. 8, 2012, and claims priority to U.S. Provisional Application No. 61/521,516, filed Aug. 9, 2011.

TECHNICAL FIELD

The present disclosure relates generally to latches, and more specifically to push/push latches. By way of example only, such latches may find application in locking bins and other storage containers in various environments of use including automotive vehicles, aircraft and the like.

BACKGROUND

It is known that push/push latches (i.e., push to open/push to close latches) are used in various applications to perform various functions. One environment of use for push/push latches is in the production of various transportation vehicles. In the transportation industry, push/push latches are used in many applications such as overhead or dashboard compartments. By way of example only, to open an overhead compartment such as a sunglasses bin or the like, a user may push on the compartment door which will release the latch holding the compartment causing the compartment to open. A similar pushing action on the compartment door will cause the compartment to close and the latch to engage the compartment, thereby holding the compartment in the closed position.

Many different configurations of push/push latches are known. In one exemplary construction, a push/push latch device may include a reciprocating track, a housing surrounding the track, and a follower with a pin that moves in the track to actuate the push/push latch. Some known push/push latches may have a tendency to unlatch when a significantly large force is exerted on them, such as during a vehicle collision event. In an effort to address this problem, some prior devices have used a blocking plate to prevent the pin from moving in the track during unwanted forces. A potential drawback with this design is that when subjected to extreme forces, the blocking plate has the potential to sever or deform the pin thereby preventing subsequent, future use of the latch. Another known drawback with this design is that during a low force situation, such as a low impact vehicle collision, the plate may not move in a sufficiently rapid manner to block the pin to prevent the unlatching or opening of the latch.

A design which is believed to substantially overcome the problem of unlatching when subjected to large forces is disclosed in U.S. Pat. No. 7,793,995 to King et al. the contents of which are incorporated by reference herein in their entirety. While this design is highly functional, the present design is believed to represent a further useful and beneficial refinement to such art.

SUMMARY OF THE DISCLOSURE

The present disclosure is directed to a latch, specifically a push latch which may be used in various applications, including in transportation vehicles. The push latch of the present disclosure may be used in high and low g-force situations, such as those generated in high and low impact vehicle collisions. In particular, the disclosure provides a push latch having a pivotally mounted blocking hammer including a head with a lever arm extending away from the head to a counter-weight. Under normal operating conditions, the hammer is held in an inert/balanced condition. Under such normal conditions, a portion of the hammer head may be in periodic contact with a resin of tacky character defining a bumper to aid in dampening vibration. Upon the occurrence of a high impact force, the rotational force provided by the counterweight is sufficient to cause the hammer to rotate into blocking relation relative to the latching mechanism so as to prevent unlatching. In the rotated condition, the counterweight may be in contact with an optional resin of tacky character defining a bumper to reduce rebound action. The optional resin may be cured to a desired level of tackiness by UV exposure or other suitable techniques. In normal operation, the optional resin may reduce noise from the hammer hitting and rebounding relative to opposing surfaces. When the hammer is rotated into blocking relation relative to the latching mechanism, the optional resin assists in holding the hammer in the rotated blocking position continuously throughout the entire force event which may include multiple impacts in different directions such as during a roll-over event or the like.

By way of example only, and not limitation, in accordance with one exemplary aspect, the present disclosure provides a push latch mechanism including a housing having a slot with a latch body having a track disposed across a surface positioned within the housing. The latch body is movable relative to the housing such that the relative movement of the latch body defines a latch body travel path. A follower may be positioned in the slot with the follower being operatively connected to a pin extending outward from the follower and in engagement with the track, such that the pin moves along the track while the follower moves along the slot. A hammer may be pivotally mounted about an axis of rotation below the latch body. The hammer may include a curved hammer head extending away from a lever arm and towards the latch body such that the lever arm and hammer head form a dogleg profile. A counter-weight may extend away from the lever arm and away from the latch body at a position remote from the hammer head. A biasing spring may be positioned between the counter-weight and the axis of rotation such that the biasing spring urges the lever arm and counter-weight towards the latch body. The hammer is movable between a first position and a second position, such that in the first position the head does not obstruct the travel path of the latch body, and such that in the second position the hammer head does obstruct the travel path of the latch body, thereby preventing the latch mechanism from opening. When moving from the first position to the second position due to a g-force condition, the counterweight moves in a first direction, and when the g-force condition has sufficiently dissipated, the hammer moves back to the first position in a direction that is opposite the first direction. A hammer head bumper of tacky, pliable resin may be disposed along a wall of the housing in opposing relation to an outboard surface of the hammer head such that rotation of the hammer head brings the outboard surface into contact with the hammer head bumper. This hammer head bumper aids in reducing noise from the hammer hitting and rebounding relative to opposing surfaces. A counter-weight bumper of tacky, pliable resin may be disposed at a wall positioned along a travel arc for the counter-weight in opposing relation to an inboard surface of the counter-weight such that rotation of the hammer head brings the inboard surface of the counter-weight into contact with the counter-weight bumper. The counter-weight bumper assists in suspending the hammer temporarily from moving back to the first position for a period of time after the g-force is dissipated.

Other exemplary features and advantages of the disclosure will become apparent to those of skill in the art upon review of the following detailed description, claims and drawings.

Figure 1:
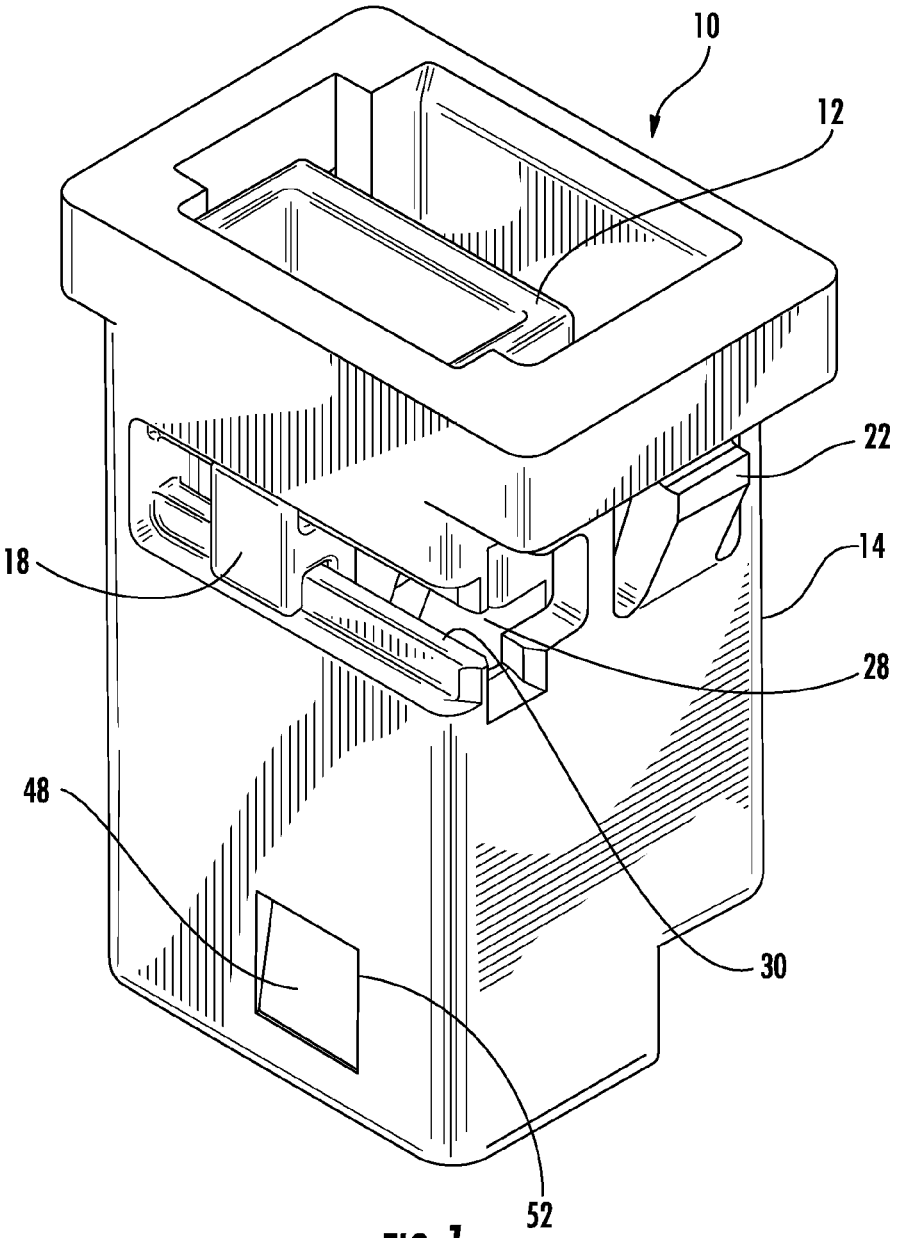
FIG. 1 is a schematic perspective view illustrating an exemplary push/push latch consistent with the present disclosure.

Before exemplary embodiments are explained in detail, it is to be understood that the disclosure is in no way limited in its application or construction to the details and the arrangements of the components set forth in the following description or illustrated in the drawings. Rather, a load transfer apparatus in accordance with the present disclosure is capable of other embodiments and of being practiced or carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 2:
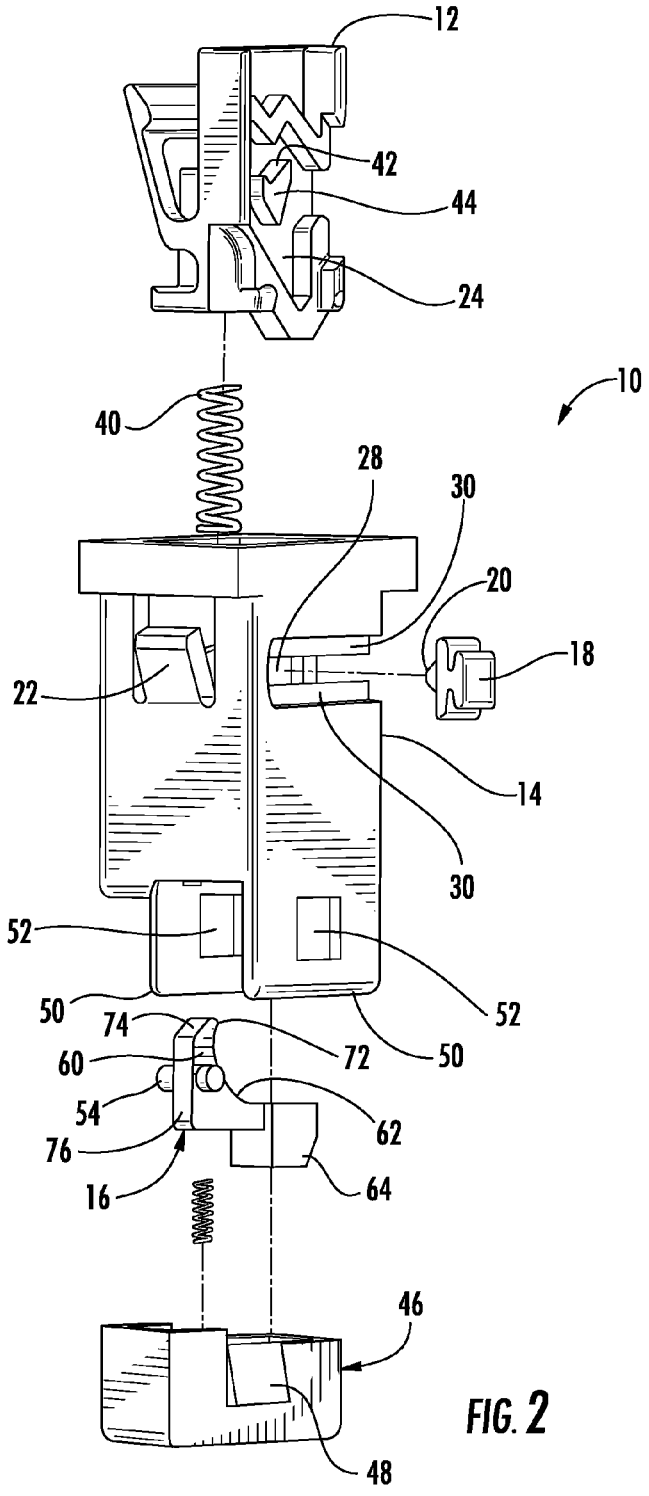
FIG. 2 is an exploded view illustrating the components of the exemplary push/push latch of FIG. 1 in separated condition.
Figure 3:
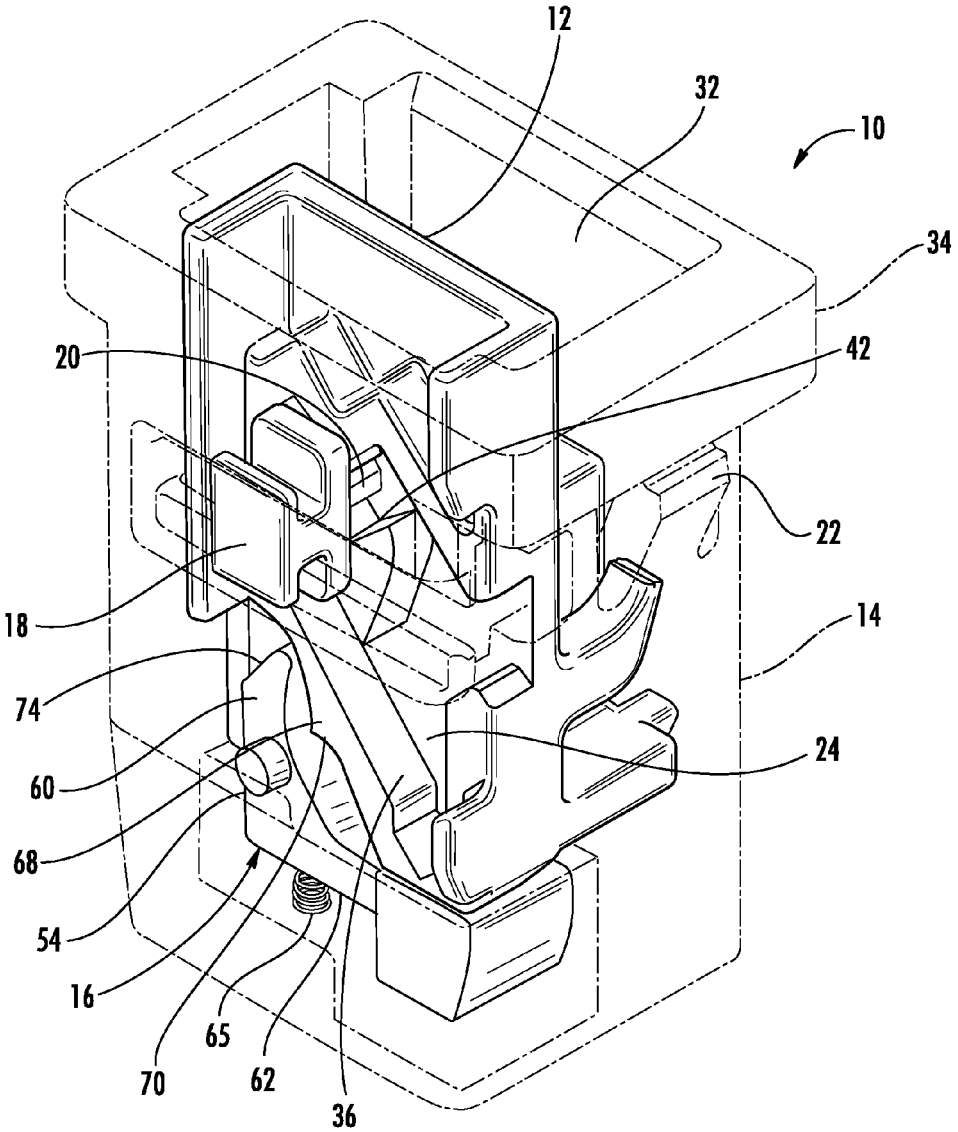
FIG. 3 is a schematic perspective view illustrating the interior of the exemplary push/push latch of FIG. 1.
Figure 6:
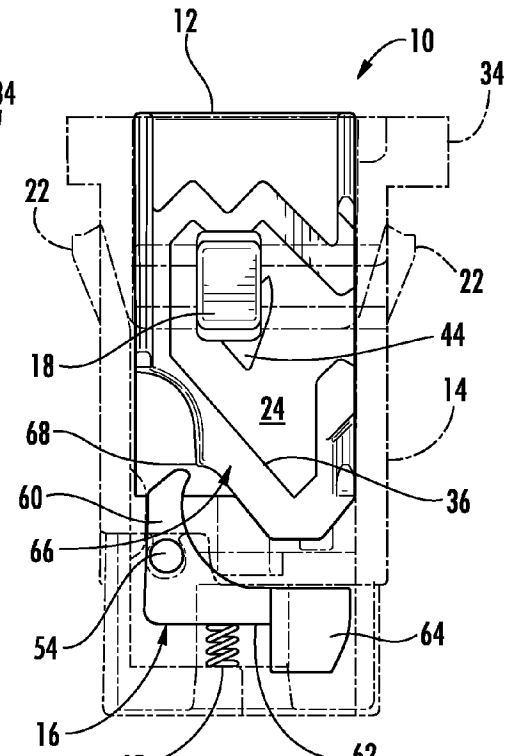
FIGS. 4-6 are schematic cut-away views illustrating normal operation of the exemplary push/push latch of FIG. 1.
Figure 5:
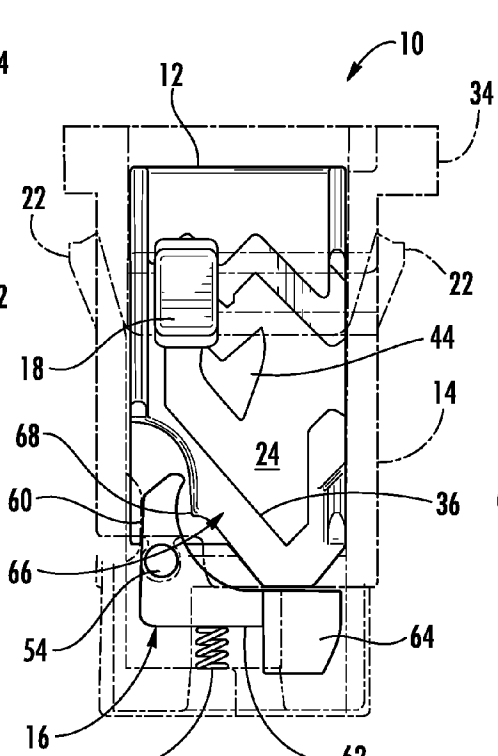

Reference will now be made to the drawings, wherein to the extent possible, like elements are designated by like reference numerals throughout the various views. Referring now to FIGS. 1-3, in one exemplary embodiment, the present disclosure is directed to a push/push latch 10 which may include a latch body 12, a housing 14 encompassing the latch body 12, a hammer 16, a follower 18, and a pin 20. The housing 14 may have numerous configurations depending on the application and may include opposing, flexible angled tab members 22 that are used to snap-fit or otherwise secure the housing and thus the latch 10 to a substrate, such as a panel of a vehicle or other mounting structures. By way of example only, and not limitation, the housing may be formed as a unitary structure from high impact plastic, acetal resin, or other suitable materials by techniques such as injection molding or the like as will be well known to those of skill in the art. Of course, other materials such as metal and the like also may be used if desired.

The housing 14 is configured to receive the latch body 12 and to permit slidable movement of the latch body 12 relative to the housing. The slidable movement of the latch body 12 within the housing 14 defines a path of travel. In this regard, during normal operation of the latch in the absence of an impact or other event producing high g-forces, the latch 10 will operate in a manner corresponding to the normal operation of the latch described in U.S. Pat. No. 7,793,995 which is hereby incorporated by reference in its entirety as if fully set forth herein.

As best seen through joint reference to FIGS. 2 and 3, the latch body 12 may include a track 24 on one side of the latch body 12. In the exemplary embodiment, the track 24 is formed by grooves and angled surfaces that define a path to allow the pin 20 to travel in camming relation along the angled surfaces within the grooves. In this regard, the pin 20 will follow the track 24 during the push/push operation of the latch 10, i.e., during the opening and closing of the latch, and the position of the pin 20 relative to the track 24 determines whether the latch is open or closed. As will be appreciated, the track 24 may be molded into the surface of the latch body 12 during the formation process and may have any number of configurations depending on the latching characteristics desired.

In the illustrated exemplary construction, the pin 20 is operatively connected to the follower 18. The follower 18 moves within an opening or slot 28 extending along the housing 14 and along opposing rails 30 positioned on opposite sides of the opening or slot 28. As will be appreciated, the follower 18 moves as the pin 20 moves along the track 24. That is, as the latch body 12 moves vertically within the housing 14 the pin 20 is held at a stationary elevation and moves along the track 24. As the pin moves along the track, the follower 18 slides back and forth along the rails 30. This slidable movement permits the latch body 12 to move relative to the housing 14, thereby causing the pin to assume various positions within the track corresponding to open and closed conditions.

Figure 4:
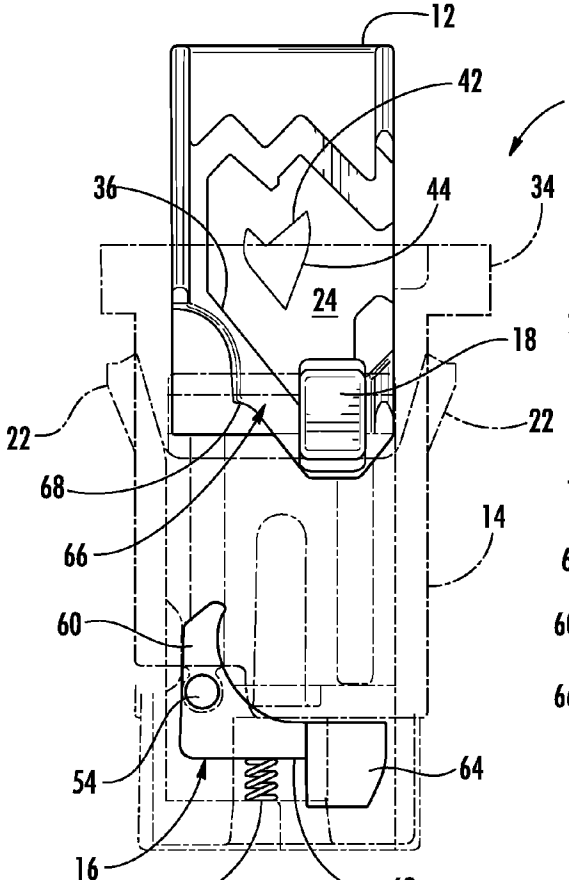

Referring now jointly to FIGS. 3-6, in the illustrated exemplary construction, when the pin 20 is at the bottom of the track 24, near distal end of the latch body 12, the latch 10 will be in an open position and the latch body 12 will extend out from an axial opening 32 in proximal end 34 of the housing 14 (FIG. 4). As the latch body 20 is depressed, the pin 20 and follower 18 move along an outer dogleg wall 36 until achieving a position corresponding to maximum push-in shown in FIG. 5. As will be well understood by those of skill in the art, the maximum push-in state is transitory only and is not maintained after the compressing force on the latch body 12 is released. In this regard, as the compressing force is released, the latch body 12 is urged upwardly by an internal latch spring 40 (FIG. 2) and the pin 20 is captured within a notch 42 on a raised island 44 at the interior of the track 24 to assume the locked position shown in FIG. 6. Since the pin 20 does not move vertically, outward movement of the latch body 12 is blocked and a latched condition is maintained. However, from the latched condition shown in FIG. 6, a user may reapply the compressing force so as to disengage the pin from the notch 42. Release of the compressing force then causes the pin 20 to resume the starting position at the bottom of the track. Of course, this sequence may be repeated numerous times over the course of use.

It is to be understood that the illustrated track configuration is merely exemplary and virtually any other track configuration as maybe known to those of skill in the art also may be used. Likewise, other configurations of the latch body, latch housing, pin and follower are possible. Accordingly, many possible latch configurations may be used in accordance with the present disclosure.

Referring to FIGS. 1 and 2, in accordance with the present disclosure, the latch 10 may include an end cap 46 of molded plastic, acetal resin, or the like adapted for connection in at least partial covering relation to the distal end of the housing 14. By way of example only and not limitation, in the illustrated exemplary construction the end cap 46 may include a pair of integral, molded-in spring tabs 48 (only one shown) projecting outwardly and downwardly from opposing sidewalls. During assembly, the end cap 46 may be inserted between a pair of downwardly extending ears 50 at the distal end of the housing 14 such that the spring tabs 48 may flex inwardly and then spring outwardly through aligned window openings 52 thereby holding the end cap in place.

Figure 9:
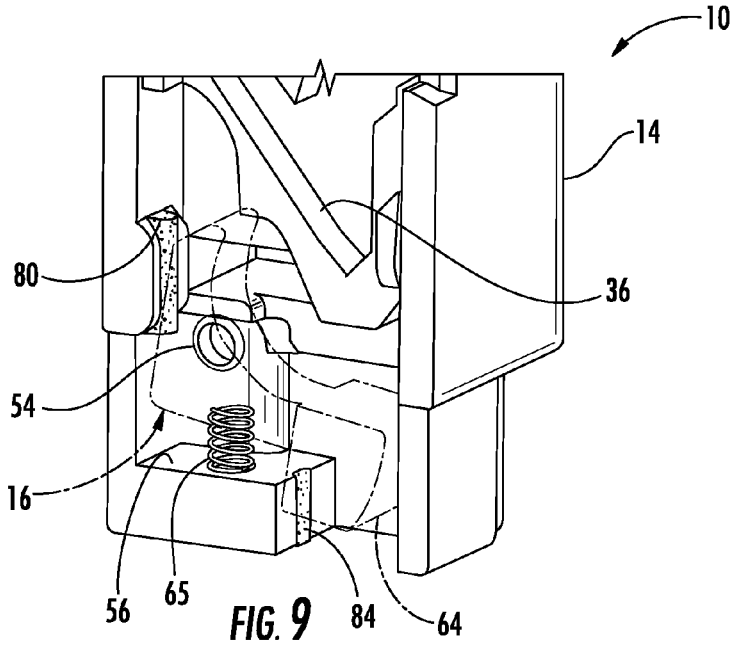
FIG. 9 is schematic cut-away view illustrating the optional placement of a tacky resin within the exemplary push/push latch of FIG. 1.
Figure 10:
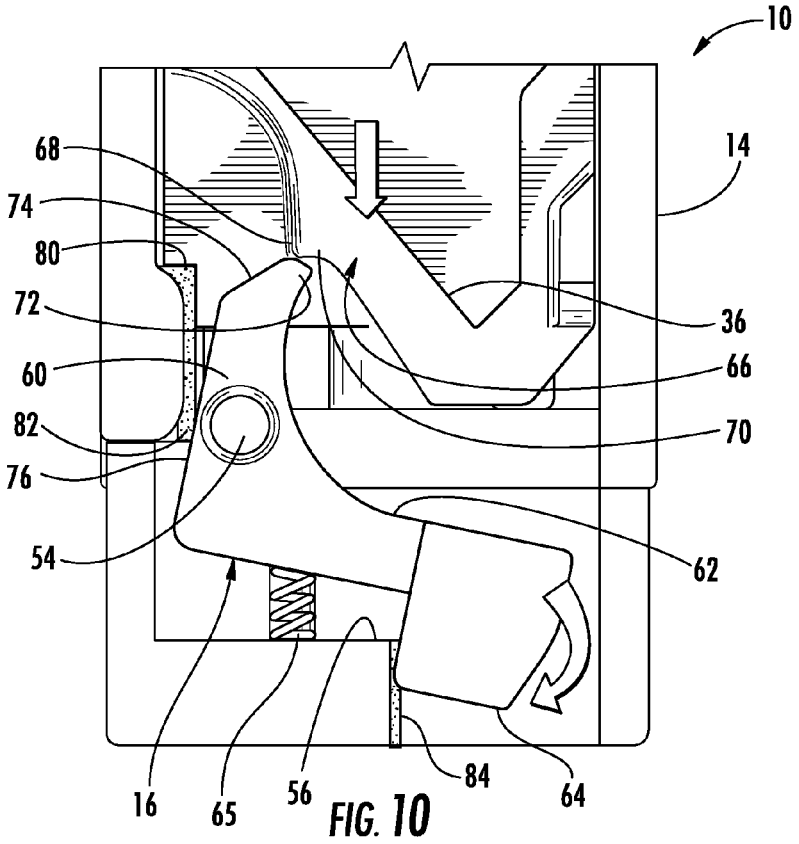
FIG. 10 is schematic cut-away view illustrating the engagement between the hammer of the exemplary push/push latch and the tacky resin.

Prior to attachment of the end cap 46 to the housing 14, the hammer 16 may be rotatably mounted within the end cap 46 by a pin 54 seated in molded-in depressions within opposing raised walls of the end cap 46. In the mounted condition, the hammer 16 is held in raised relation away from the floor surface of the end cap 46 such that the hammer 16 may rotate at least partially about an axis of rotation defined by the pin 54. As best seen in FIGS. 9 and 10, the floor of the end cap 46 may include a raised step 56 extending partially across the end cap 46 and disposed below the pin connection when the end cap 46 is in the assembled condition. As will be described further hereinafter, this raised step acts to limit rotation of the hammer 16 during operation.

In accordance with the illustrated exemplary embodiment, the hammer 16 may have a generally dogleg configuration having a curved hammer head 60 extending in upwardly angled relation away from a lever arm 62 such that the axis of rotation defined by the pin 54 is slightly above the intersection between the hammer head 60 and the lever arm 62. However, other pin positions also may be used. In the illustrated embodiment, the hammer 16 also includes a counter-weight 64 positioned opposite the hammer head 60 such that the lever arm 62 extends operatively between counter-weight 64 and hammer head 60. A relatively light weight spring 65 may be disposed in upward biasing relation to the lever arm 62 at a position between the pin 54 and the counter-weight 64. As further explained below, in the event of a g-force condition exceeding the range of normal operating conditions, the counter-weight 64 will pivot about the pin 54, thereby overcoming the biasing force of spring 65 and causing the hammer head 60 to move into the path of travel of the latch body 12. In this blocking position, further movement of the latch body 12 is prevented, and the latch body 12 is thereby precluded from moving to an open or unlatched position.

Figure 8:
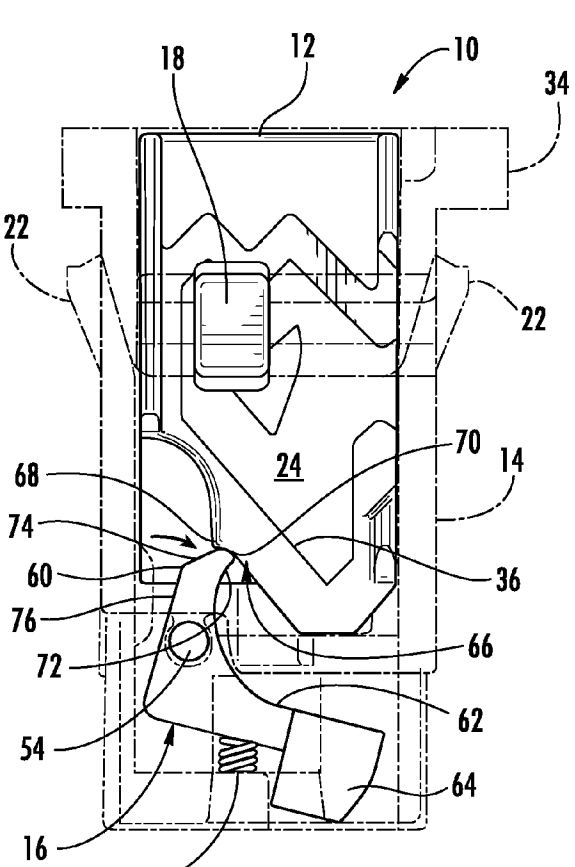
FIGS. 7-8 are schematic cut-away views illustrating operation of the exemplary push/push latch of FIG. 1 when subjected to a high g-force event while in a latched condition.
Figure 7:
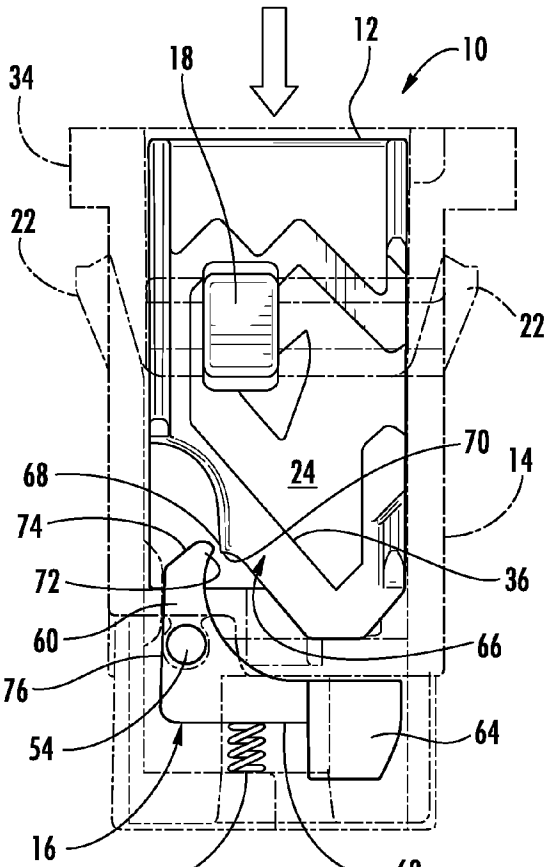

Referring now to FIGS. 7 and 8, in the illustrated exemplary construction the outboard side 66 of the outer dogleg wall 36 may include an outwardly projecting nose 68 extending generally towards the hammer 16. As best seen in FIGS. 8 and 10, the lower edge of the outwardly projecting nose 68 may form a shoulder 70 positioned to engage the distal end of the hammer head 60 when the hammer 16 rotates during a g-force condition. That is, when the latch 10 is subject to a g-force condition, such as during a collision event, the hammer counter-weight 64 will rotate about the connecting pin 54 until the hammer head 60 moves into the path of travel of the latch body 12. This rotation takes place until the counter-weight 64 contacts the opposing surface of the raised step 56. As the g-force condition causes the latch body 12 to move within the housing 14, the shoulder 70 will contact the hammer head 60 which will stop further movement of the latch body 12. Thus, the latch body 12 is held in the latched position as illustrated in FIG. 8. During this blocked condition, downwardly applied force on the latch body 12 will continue to urge the hammer 16 to the blocking position shown in FIG. 8. However, when the g-force condition has dissipated or when no g-force is exerted on the latch 10, the hammer spring 65 in combination with the mass of the hammer head 60 overcomes the counter-weight and the hammer head 60 rotates back to its neutral position (FIG. 7). In this neutral position, the latch 10 will thereafter be fully operational. Thus, the latch 10 may be reused following the collision event.

As best seen in FIGS. 2, 7 and 8, the hammer head 60 may have a generally claw-shaped profile having a rounded distal tip 72 which projects rearwardly at an angle towards a wall of the housing corresponding to a plane disposed in opposing adjacent relation to the outboard surface of the counter-weight 64. As shown, a substantially planar upper surface 74 may extend in radially inwardly angled relation to a substantially planar hammer head outboard surface 76. In the illustrated, exemplary construction, the hammer head outboard surface 76 may form a substantially right angle with the lever arm 62, although other angled relationships may be used. Of course, it is to be understood that while a potentially preferred embodiment for a hammer has been illustrated and described, any number of other hammer configurations may likewise be used. Accordingly, as used herein, the term "hammer" refers to any device that, in the event of a g-force condition, may move into or otherwise obstruct the path of movement of the latch body 12 or otherwise prevent the opening of the latch.

Referring now to FIGS. 9 and 10, in accordance with one exemplary practice, a resin or other curable fluid of slightly tacky surface character in the cured condition may be positioned in opposing relation to the hammer head outboard surface 76 and/or across the outboard surface of the raised step 56 in opposing relation to the inboard surface of the counter weight 64. It has been found that the presence of such a slightly tacky material may aid in reducing vibration or chattering in the hammer during normal operating conditions. Moreover, the presence of such a slightly tacky resin may aid in preventing the counter-weight 64 from rebounding back towards the neutral position upon impact against the raised step 56. This avoidance of rebounding may be particularly beneficial during the occurrence of extremely high g-force events.

By way of example only, and not limitation, a tacky resin such as an ultraviolet light-curable resin or other similar material may be injected through a pinhole (not shown) in the housing 14 to fill a containment slot on the interior wall of the housing positioned in opposing relation to the hammer head outboard surface 76. The injected resin may form a raised profile hammer head bumper 80 of slightly tacky character. The hammer head bumper 80 may be disposed in close spaced relation to the hammer head outboard surface 76 such that movement of the hammer head 60 in either direction will bring a portion of the hammer outboard surface 76 into contact with the hammer head bumper 80. During normal operations, naturally occurring vibrations may cause the hammer 16 to oscillate about the pin 54 thereby bringing the hammer head outboard surface 76 periodically into contact with the hammer head bumper 80. However, the presence of the slightly tacky hammer head bumper 80 will tend to dampen such oscillation by applying a drag on the movement of the hammer head 60 by virtue of the tacky surface character.

As shown in FIG. 10, the hammer head bumper 80 may include a lower tail segment forming a free end 82 which projects below the containment slot. As will be appreciated, the free end 82 is pliable and may bend to some degree when subjected to substantial force applied by the hammer head 60 during a high g-force event. The tacky surface character of the hammer head bumper 80 will also act to grip the hammer head outboard surface 76 in the rotated condition, thereby prolonging the blocking period.

A tacky resin such as an ultraviolet, light-curable resin or other similar material also may be injected through a pinhole (not shown) in the end cap 46 to fill a containment slot on the outboard surface of the raised step 56 positioned in opposing relation to the counter-weight 64. The injected resin may form a raised profile counter-weight bumper 84 of slightly tacky character. When the hammer is rotated into blocking relation relative to the latching mechanism, the counter-weight bumper 85 assists in holding the hammer 16 in the rotated blocking position continuously throughout the entire force event. In a transportation vehicle this may include multiple impacts in different directions such as during a roll-over event or the like. In this regard, the tacky surface character of the counter-weight bumper 84 will act to grip the inboard surface of the counter-weight 64 in the rotated condition (FIG. 10). This gripping action will act to reduce any rebound effects during a high g-force event and will act to prolong the active blocking period throughout the entire force event. However, spring 65 will urge the counter-weight 64 away from the counter-weight bumper 84 such that there is disengagement after the force event is concluded. The level of tackiness, and thus the duration of adhesion may be controlled by a combination of the force of spring 65 and the degree of curing the counter-weight bumper 84.

By way of example only, and not limitation, it is contemplated that the same resin material may be used to form both the hammer head bumper 80 and the counter-weight bumper 84. However, different materials also may be used. One suitable resin material is a form-in-place and cure-in-place gasketing resin fluid marketed by DYMAX® Corporation of Torrington, Conn. under the trade designation GA-110 or GA 112. However, it is contemplated that any number of other injectable fluids providing a tacky surface character in a cured state also may be used if desired Of course, variations and modifications of the foregoing are within the scope of the present disclosure. All dimensions are merely exemplary. Thus, it is to be understood that the disclosure disclosed and defined herein extends to all alternative combinations of two or more of the individual features mentioned or evident from the text and/or drawings. All of these different combinations constitute various alternative aspects of the present disclosure.

What is claimed is:

1. A push latch mechanism comprising: a housing including a slot; a latch body having a track disposed across a surface, the latch body being positioned within the housing and being movable relative to the housing such that the relative movement of the latch body defines a latch body travel path;

a follower positioned in the slot, the follower being operatively connected to a pin extending outward from the follower and in engagement with the track, such that the pin moves along the track while the follower moves along the slot;

a hammer pivotally mounted at a pin within an end cap secured to the housing, the pin defining an axis of rotation below the latch body, the hammer including a hammer head extending away from a lever arm and towards the latch body such that the lever arm and hammer head form a dogleg profile and a counter-weight extending away from the lever arm and away from the latch body at a position remote from the hammer head and wherein the pin is disposed above the intersection of the hammer head and the lever arm;

a biasing spring engaging the hammer at a position on the lever arm between the counter-weight and the axis of rotation, the biasing spring urging the lever arm and counter-weight towards the latch body, wherein the hammer is movable between a first position and a second position, such that in the first position the hammer head does not obstruct the travel path of the latch body, and such that in the second position the hammer head obstructs the travel path of the latch body, thereby preventing the latch mechanism from opening, such that when moving from the first position to the second position due to a g-force condition occurring during a collision, the counterweight moves in a first direction, and such that when the g-force condition has sufficiently dissipated, the hammer moves back to the first position in a direction that is opposite the first direction and wherein the hammer head in combination with a biasing force applied by the biasing spring overcomes the counterweight in the absence of the g-force condition.

2. The push latch mechanism of claim 1, wherein a hammer head bumper of tacky, pliable resin is disposed along a wall of the housing in opposing relation to an outboard surface of the hammer head such that rotation of the hammer head brings the outboard surface into contact with the hammer head bumper.

3. The push latch mechanism of claim 2, wherein the hammer head bumper is disposed within a containment slot along an interior wall of the housing such that an exterior surface of the hammer head bumper extends in raised relation outwardly from the containment slot.

4. The push latch mechanism of claim 3, wherein the hammer head bumper includes a free end extending below the containment slot, the free end being positioned such that the hammer head contacts the free end when the hammer is in the second position.

5. The push latch mechanism of claim 1, wherein a counter-weight bumper of tacky, pliable resin is disposed in opposing relation to an inboard surface of the counter-weight such that rotation of the hammer head brings the inboard surface of the counter-weight into contact with the counter-weight bumper.

6. The push latch mechanism of claim 5, wherein the counter-weight bumper is disposed within a containment slot along a wall positioned along a travel arc for the counter-weight and wherein the counter-weight bumper extends in raised relation outwardly from the wall.

7. The push latch mechanism of claim 6, wherein the counter-weight bumper is disposed within the containment slot along an outboard wall of a raised step positioned along the travel arc for the counter-weight within the end cap secured to the housing.

8. A push latch mechanism comprising: a housing including a slot; a latch body having a track disposed across a surface, the latch body being positioned within the housing and being movable relative to the housing such that the relative movement of the latch body defines a latch body travel path, the latch body including an outwardly projecting nose disposed below the track;

a follower positioned in the slot, the follower being operatively connected to a pin extending outward from the follower and in engagement with the track, such that the pin moves along the track while the follower moves along the slot;

a hammer pivotally supported by a single mounting pin within an end cap secured to the housing, the mounting pin defining an axis of rotation below the latch body, the hammer including a claw-shaped hammer head extending away from a lever arm and towards the latch body such that the lever arm and hammer head form a dogleg profile and a counter-weight extending away from the lever arm and away from the latch body at a position remote from the hammer head, wherein the mounting pin is disposed above the intersection of the hammer head and the lever arm, the hammer head having a distal tip projecting generally towards the outwardly projecting nose;

a biasing spring engaging the hammer at a position on the lever arm between the counter-weight and the axis of rotation, the biasing spring urging the lever arm and counter-weight towards the latch body, wherein the hammer is movable between a first position and a second position, such that in the first position the hammer head does not obstruct the travel path of the latch body, and such that in the second position the distal tip of the hammer head contacts a surface of the outwardly projecting nose of the latch body, thereby preventing the latch mechanism from opening, such that when moving from the first position to the second position due to a g-force condition occurring during a collision, the counterweight moves in a first direction, and such that when the g-force condition has sufficiently dissipated, the hammer moves back to the first position in a direction that is opposite the first direction and wherein the hammer head in combination with a biasing force applied by the biasing spring overcomes the counterweight in the absence of the g-force condition.

9. The push latch mechanism of claim 8, wherein a hammer head bumper of tacky, pliable resin is disposed along a wall of the housing in opposing relation to an outboard surface of the hammer head such that rotation of the hammer head brings the outboard surface into contact with the hammer head bumper.

10. The push latch mechanism of claim 9, wherein the hammer head bumper is disposed within a containment slot along an interior wall of the housing such that an exterior surface of the hammer head bumper extends in raised relation outwardly from the containment slot.

11. The push latch mechanism of claim 10, wherein the hammer head bumper includes a free end extending below the containment slot, the free end being positioned such that the hammer head contacts the free end when the hammer is in the second position.

12. The push latch mechanism of claim 8, wherein a counter-weight bumper of tacky, pliable resin is disposed in opposing relation to an inboard surface of the counter-weight such that rotation of the hammer head brings the inboard surface of the counter-weight into contact with the counter-weight bumper.

13. The push latch mechanism of claim 12, wherein the counter-weight bumper is disposed within a containment slot along a wall positioned along a travel arc for the counter-weight and wherein the counter-weight bumper extends in raised relation outwardly from the wall.

14. A push latch mechanism comprising: a housing including a slot; a latch body having a track disposed across a surface, the latch body being positioned within the housing and being movable relative to the housing such that the relative movement of the latch body defines a latch body travel path, the latch body including an outwardly projecting nose disposed below the track;

a follower positioned in the slot, the follower being operatively connected to a pin extending outward from the follower and in engagement with the track, such that the pin moves along the track while the follower moves along the slot;

a hammer pivotally supported by a single mounting pin within an end cap secured to the housing, the mounting pin defining an axis of rotation below the latch body, the hammer including a claw-shaped hammer head extending away from a lever arm and towards the latch body such that the lever arm and hammer head form a dogleg profile and a counter-weight extending away from the lever arm and away from the latch body at a position remote from the hammer head, wherein the mounting pin is disposed above the intersection of the hammer head and the lever arm, the hammer head having a distal tip projecting generally towards the outwardly projecting nose;

a biasing spring engaging the hammer at a position on the lever arm between the counter-weight and the axis of rotation, the biasing spring urging the lever arm and counter-weight towards the latch body, wherein the hammer is movable between a first position and a second position, such that in the first position the hammer head does not obstruct the travel path of the latch body, and such that in the second position the distal tip of the hammer head contacts a surface of the outwardly projecting nose of the latch body, thereby preventing the latch mechanism from opening, such that when moving from the first position to the second position due to a g-force condition during a collision, the counterweight moves in a first direction, and such that when the g-force condition has sufficiently dissipated, the hammer moves back to the first position in a direction that is opposite the first direction, wherein a hammer head bumper of tacky, pliable resin is disposed along a wall of the housing in opposing relation to an outboard surface of the hammer head such that rotation of the hammer head brings the outboard surface into contact with the hammer head bumper and wherein a counter-weight bumper of tacky, pliable resin is disposed at a wall positioned along a travel arc for the counter-weight in opposing relation to an inboard surface of the counter-weight such that rotation of the hammer head brings the inboard surface of the counter-weight into contact with the counter-weight bumper and wherein the hammer head in combination with a biasing force applied by the biasing spring overcomes the counterweight in the absence of the g-force condition.

* * * * *